US005900798A

United States Patent [19]

Hanazaki et al.

[11] Patent Number: 5,900,798

[45] Date of Patent: May 4, 1999

[54] CURRENT LIMITING FUSE HAVING A NON-DIRECTIONAL FUSING CHARACTERISTIC

[75] Inventors: Hisashi Hanazaki, Canton, Mich.; Kenji Muramatsu, Shizuoka, Japan; Mitsuhiko Totsuka, Shizuoka, Japan; Toshiharu Kudo, Shizuoka, Japan

[73] Assignee: Yazaki Corporation, Tokyo, Japan

[21] Appl. No.: 09/048,255

[22] Filed: Mar. 26, 1998

[30] Foreign Application Priority Data

Mar. 28, 1997 [JP] Japan ..... 9-078232

[51] Int. Cl.[6] ..... H01H 85/11; H01H 85/04; H01H 85/06; H01H 85/08

[52] U.S. Cl. ..... 337/160; 337/159; 337/152; 337/166; 337/198

[58] Field of Search ..... 337/160, 152, 337/166, 198, 260, 261, 262, 264, 265, 159; 439/621, 622

[56] References Cited

U.S. PATENT DOCUMENTS 3,291,943 12/1966 Kozacka ..... 200/120
3,705,373 12/1972 Cameron ..... 337/160
4,219,795 8/1980 Panaro et al. ..... 337/296
5,661,448 8/1997 Totsuka et al. ..... 337/160

FOREIGN PATENT DOCUMENTS 3-13960 3/1991 Japan .
7-14494 1/1995 Japan .

*Primary Examiner*—Leo P. Picard
*Assistant Examiner*—A. Vortman
*Attorney, Agent, or Firm*—Armstrong, Westerman, Hattori, McLeland & Naughton

[57] ABSTRACT

In the metal piece 32 which diffuses into the fuse element so that an alloy layer is generated, there is formed an expanding slot 30, which is inserted and pressured in the fusing portion 25*b* of the fusible body 25 which forms the fuse element. Due to the foregoing, the metallic mass 32 of low fusing point is fixed to the fusible body 25 while it surrounds the circumferential surface of the fusing portion 25*b*.

3 Claims, 3 Drawing Sheets

CURRENT LIMITING FUSE HAVING A NON-DIRECTIONAL FUSING CHARACTERISTIC

BACKGROUND OF THE INVENTION

1. Field of the Invention

The present invention relates to a fuse including: a fuse element in which a pair of connecting terminals and a fusible body to connect electrically the pair of connecting terminals are integrally formed; and a chip-shaped metallic piece with low fusing point for adjusting the fusing characteristic of the fusible body, wherein the metallic piece is attached to the fuse element.

2. Related Art

In Japanese Examined Utility Model Publication No. 3-13960 or Japanese Unexamined Patent Publication No. 7-14494, there is disclosed a fuse of large electrical capacity in which a mass of metal of low fusing point such as tin or lead is held in the middle in the longitudinal direction of a fusible body which forms a fuse element, and the fusing characteristic of the fuse is improved by alloy generated by the diffusion of the metal of low fusing point.

FIG. 4 is a perspective view showing an example of the conventional fuse which is similar to the fuse disclosed in the above utility model and patent publications.

The fuse 1 shown here is a fusible link, which is attached to an insulating housing not shown in the drawing. This fuse 1 includes: terminal connecting portions 3, 3 formed at both ends; and a belt-shaped fusible body 5 to connect electrically the terminal connecting portions 3, 3 with each other, wherein the terminal connecting portions 3, 3 and the belt-shaped fusible body 5 are integrally formed by means of press forming.

In this connection, both ends of the connecting terminal portions 3, 3 are curved inside. Accordingly, on the fore end side of the connecting terminal, that is, at the lower portion of the connecting terminal in the drawing, there is formed an electrical contacting portion S with which a tongue-shaped male connecting terminal is engaged and connected.

The fusible body 5 is composed in such a manner that a pair of narrow leg pieces 5*a*, 5*a* continued to the connecting terminal portions 3, 3 are connected with each other and that a chip-shaped metallic mass 8 of low fusing point, which is lower than the fusing point of the fusible body 5, is attached to the intermediate portion in the longitudinal direction of the connecting terminal portions by a pair of calking pieces 7. In this connection, the calking pieces 7 are formed in such a manner that they extend in the width direction of the fusible body 5. When the calking pieces 7 are calked being curved round the metallic mass 8 of low temperature, they can be pressured and fixed to the fusible body 5.

The fuse 1 composed as described above is attached to an electrical circuit via the electrical contacting portion S. When a voltage is impressed between the terminal connecting portions 3, 3, the fuse element 2 is energized with electric current. Then, as shown in FIG. 5, the metallic mass 8 of low fusing point diffuses in the fuse element 2, so that an alloy layer 9 is formed on the fusible body 5 side. Since the specific resistance of the alloy layer 9 is higher than the specific resistances of the metallic mass 8 of low temperature and the fuse element 2, Joule's heat is generated on the alloy layer 9 at this time. Therefore, the fuse element 2 is fused off by the influence of Joule's heat.

In this connection, since diffusion of metal proceeds to the direction of gravity, a contact surface of the metallic mass 8 of low fusing point with the fuse element 2, that is, a surface on which the alloy layer 9 is formed remarkably appears in one direction which corresponds to the direction of fuse setting.

Accordingly, when the fuse setting direction is changed variously being restricted by the space in an actual vehicle when the fuse is incorporated into the vehicle, that is, when the fuse setting direction is set laterally or reversely, the fusion characteristic of the fuse is varied, that is, when the fuse setting direction is set laterally or reversely, the fusing time is extended.

SUMMARY OF THE INVENTION

The present invention has been accomplished in view of the above circumstances. It is an object of the present invention to provide a fuse, the fusing characteristic of which is not varied even if the fuse setting direction is varied, so that it is possible to obtain a stable fuse performance by the fuse at all times.

In order to accomplish the above object, the present invention is to provide a fuse in which an alloy layer is formed by the diffusion of a metallic mass of low fusing point, which is held by a fuse element, into the fuse element when the metallic mass is energized with electric current and the alloy layer is heated so as to fuse the fuse element, wherein the metallic mass of low fusing point is attached to the fuse element while it surrounds the circumferential surface of the fuse element, and the alloy layer is uniformly generated in each portion of the fuse element.

The metallic mass of low fusing point is attached to the fusible body in such a manner that the metallic mass of low fusing point surrounds the circumferential surface of the fusible body and uniformly comes into contact with the circumferential surface of the fusible body. Therefore, even if the fuse is set in any direction, diffusion of the metallic mass of low fusing point, which is facilitated in the direction of gravity, can be conducted under the same condition at all times. As a result, even if the fuse is set in any direction, the alloy layer which diffuses into the fuse element is generated to the same extent. Accordingly, it is possible to provide a stable fuse performance in which the fusing characteristic is not varied.

BRIEF DESCRIPTION OF THE PREFERRED EMBODIMENTS

FIG. 5 is a cross-sectional view taken on surface A—A in FIG. 4, wherein FIG. 5 shows a state of an alloy layer.

DETAILED DESCRIPTION OF THE PREFERRED EMBODIMENTS

Figure 1:
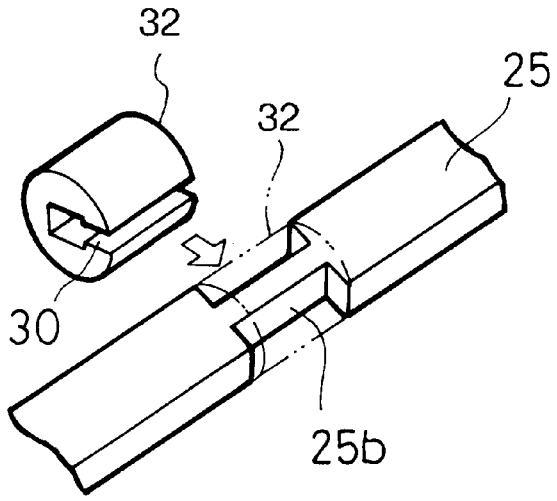
FIG. 1 is an enlarged perspective view of the fuse of the present invention in a state before the metallic mass of low fusing point is attached.
Figure 2:
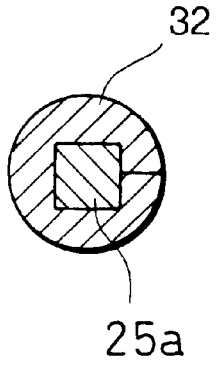
FIG. 2 is a cross-sectional view of the primary portion of FIG. 1.
Figure 3:
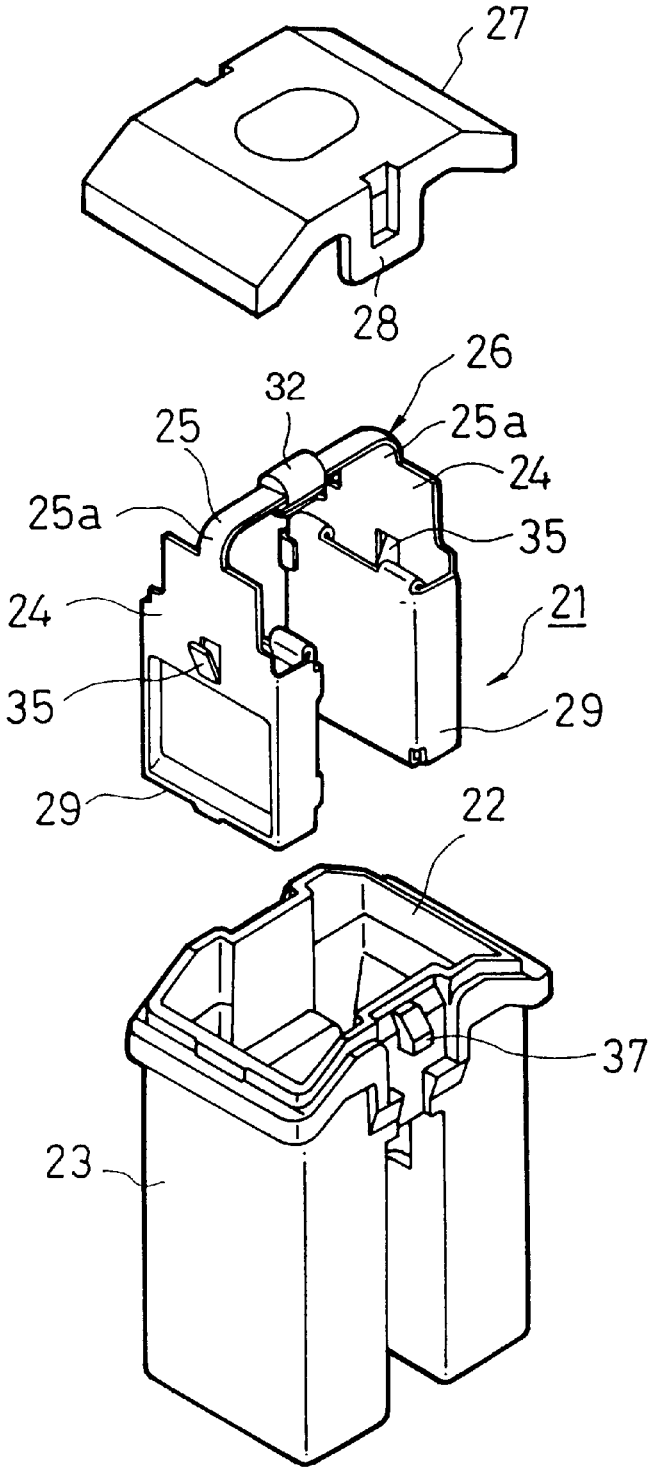
FIG. 3 is an exploded perspective view of the fuse of the present invention.
Figure 4:
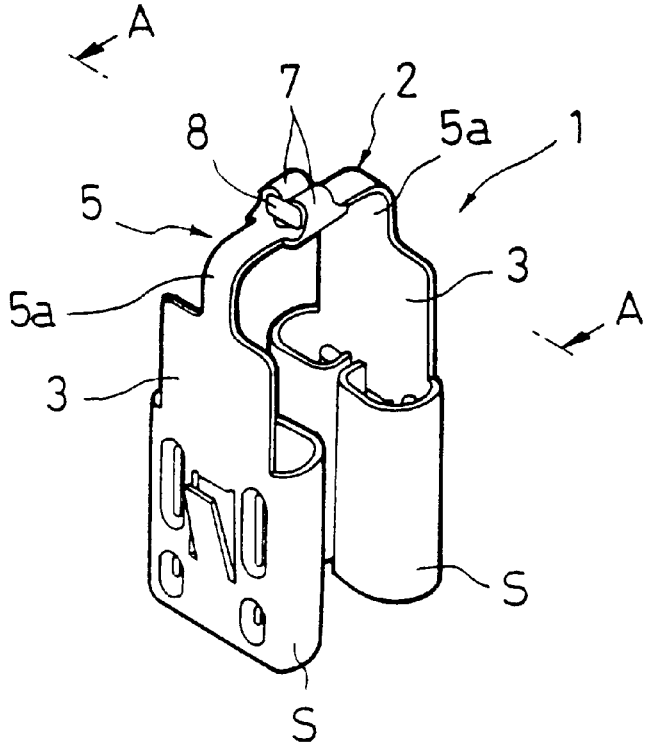
FIG. 4 PRIOR ART
FIG. 4 is a perspective view of the fuse element applied to the conventional fuse.

Referring to the accompanying drawings, a preferred embodiment of the fuse of the present invention will be explained in detail as follows. FIGS. 1 to 3 are views showing an embodiment of the fuse of the present invention. FIG. 1 is an enlarged perspective view of the primary portion of the fuse of the present invention in a state before a chip-shaped metallic mass of low fusing point is attached.

FIG. 2 is a cross-sectional view of the primary portion. FIG. 3 is an exploded perspective view of the fuse.

As shown in FIG. 3, the fuse 21 of this embodiment includes: a housing 23 made of insulating resin which is integrally formed into one body by means of injection molding, on one end of which an open surface 22 is formed into which a fuse element is inserted; a fuse element 26 having a pair of connecting terminals 24, 24 and a belt-shaped fusible body 25 to connect base end portions of the pair of connecting terminals 24, 24, the fuse element 26 being formed into one body by means of press forming, the fuse element 26 being inserted into the housing 23 from the open surface 22; and a cover 27 made of insulating resin which is formed by means of injection molding in the same manner as that of the housing 23, the cover 27 covering the open surface 22, the cover 27 having an engaging means for engaging with the housing 23.

In this connection, the connecting terminal 24 of the fuse element 26 includes a box-shaped electrical contact portion 29 with which a tongue-shaped male connecting terminal (not shown in the drawing) is engaged.

In this case, the fusible body 25 includes a pair of narrow leg pieces 25*a*, 25*a* connected with the connecting terminals 24, 24. At the middle of the fusible body 25 in the longitudinal direction, there is provided a chip-shaped metallic mass 32 with low fusing point, the fusing point of which is lower than that of the fusible body 25.

The metallic mass 32 of low fusing point is formed into a columnar shape, along the axis of which an expanding slot 30 is formed as shown in FIG. 1.

On the other hand, in a portion of the fusible body 25 to which the metallic mass 32 with low fusing point is attached, there is formed a fusing portion 25*b* in which the width of the belt-shaped plate of the fusible body 25 is partially reduced so that it can be easily fused off according to a desired fusing characteristic.

After the expanding slot 30 of the metallic mass 32 with low fusing point has been inserted into the fusing portion 25*a* of the fusible body 25, the metallic mass 32 of low fusing point is mechanically pressured so that the expanding slot can be crushed. Due to the foregoing, as shown in FIG. 2, the fusing portion 25*b* of the fuse element 26 is surrounded by the metallic mass 32 with low fusing point, and further the metallic mass 32 with low fusing point is fixed to the fuse element 26 while it comes into contact with the circumferential surface of the fusing portion 25*b*. Furthermore, in this embodiment, the metallic mass 32 with low fusing point is heated when it is irradiated with laser beams, so that the metallic mass 32 with low fusing point can be fused with the fusing portion 25*b*. Therefore, the contact surface area is increased, and the contact property of the metallic mass 32 of low fusing point with the fuse element 26 can be enhanced.

The thus composed fuse element 26 is inserted into the housing from the open surface 22 of the housing 23. An elastic engaging protrusion 35 formed on the back of each electrical contact portion 29 is engaged with a step portion (not shown) formed on the inner wall surface of the housing 23. In this way, the fuse element 26 can be fixed and held in the housing 23. Next, the cover 27 is set on the open surface 22 of the housing 23, and the engaging means 28 of the cover 27 is engaged with the engaging protrusion 37 protruding from the outside of the housing 23. In this way, the fuse 21 is assembled. When the thus composed fuse 21 is incorporated into an electrical circuit via the electrical contact portions 29, 29, a voltage is impressed between the terminal contact portions 24, 24.

Figure 5:
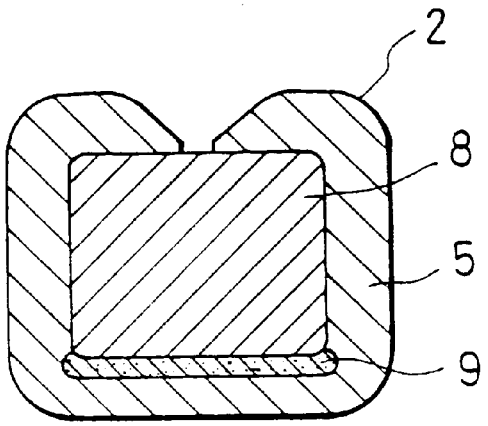
FIG. 5 PRIOR ART

Therefore, an electrical current flows in the fuse element 26. In the fuse 21 of this embodiment, the metallic mass 32 with low fusing point surrounds the circumferential surface of the fuse element 26 and is fixed to the fuse element 26 under the condition of uniform contact. Therefore, as can be seen in FIG. 2, even when the fuse 21 is set sideways from the state shown in FIG. 3 in such a manner that the fuse 21 is turned round the longitudinal axis of the fusible body 25, or alternatively even when the fuse 21 is reversed in such a manner that the fuse 21 is turned downward, the metallic mass 32 with low fusing point diffuses to the same extent in a portion of the fusing portion 25*a* which is located in the direction of gravity. Therefore, an alloy layer can be formed as shown in FIG. 5. That is, generation of the alloy layer 9 facilitated in the direction of gravity becomes substantially the same in each portion of the fuse element 26 corresponding to the direction of setting. Accordingly, even if the fuse 26 is attached in either direction of setting, a quantity of Joule's heat is the same which is generated on the alloy layer formed to the same extent. Accordingly, there is no possibility of difference in the fusing time. As a result, it is possible to obtain a stable fuse characteristic at all times.

In the fuse 21 of this embodiment, the metallic mass 32 with low fusing point is fused with the fusing portion 25*b* when it is irradiated with laser beams, so that the contact surface area can be increased, which acts advantageously on the generation of Joule's heat and the formation of the alloy layer.

As described above, according to the fuse of the present invention, even if the fuse is set in any direction, there is no possibility of difference in the fusing time. Consequently, it is possible to obtain a stable fuse characteristic at all times, and the reliability of the fuse can be enhanced.

What is claimed is:

1. A current limiting fuse having a non-directional fusing characteristic, comprising:

a columnar shaped metal piece made of a metallic mass with a low melting point; and having an expanding slot and a fuse element having a fusible portion of reduced cross-sectional area, wherein said metal piece surrounds and uniformly contacts with the whole circumferential surface of said fusible portion, said metal piece is fused to said fusible portion, whereby an alloy layer, which diffuses into said fuse element in the direction of gravity, is generated to the same extent regardless of a setting direction of said fuse when said fuse is heated by an electric current.

2. The current limiting fuse having a non-directional fusing characteristic according to claim 1, wherein said expanding slot is formed in said metal piece, and said metal piece is pressured and fixed to a fusible body formed in said fuse element with said fusible body inserted into said metal piece through said expanding slot.

3. The current limiting fuse having a non-directional fusing characteristic according to claim 2, wherein said metal piece is fused to said fusible portion when it is irradiated with laser beams.

* * * * *